US005740948A

United States Patent [19]

Chu et al.

[11] Patent Number: 5,740,948

[45] Date of Patent: Apr. 21, 1998

[54] MULTI-FUNCTIONAL COMPOUND INTEGRATED BOTTLE

[76] Inventors: Wei-Yieh Chu, 2347 Westbrook Ct., Claremont, Calif. 91711; Chih-Kwei Nii, 1143 Calle Ortega, San Dimas, Calif. 91773

[21] Appl. No.: 792,372

[22] Filed: Feb. 3, 1997

[51] Int. Cl.[6] ..... B67D 5/06

[52] U.S. Cl. ..... 222/175; 222/79; 222/192; 222/129; 222/383.1; 239/289; 601/112

[58] Field of Search ..... 222/78, 79, 175, 222/192, 333, 383.1, 530, 129, 382; 239/33, 289, 152, 333; 601/84, 112, 113

[56] References Cited

U.S. PATENT DOCUMENTS

| | | | |
|---|---|---|---|
| 3,144,867 | 8/1964 | Trupp et al. | 222/383.1 X |
| 3,650,473 | 3/1972 | Malone | 222/383.1 X |
| 3,736,921 | 6/1973 | Kawada | 601/112 |
| 3,997,115 | 12/1976 | Licudine | 222/333 X |
| 4,448,316 | 5/1984 | Hiroshinge | 239/33 X |
| 4,684,032 | 8/1987 | Tsay | 239/33 X |
| 4,903,864 | 2/1990 | Sirhan | 222/78 |
| 5,215,227 | 6/1993 | Farner | 222/175 |
| 5,338,495 | 8/1994 | Steiner et al. | 239/333 X |
| 5,346,081 | 9/1994 | Lin | 222/530 X |
| 5,360,142 | 11/1994 | Stern et al. | 222/175 X |
| 5,620,633 | 4/1997 | Junkel et al. | 239/289 X |
| 5,622,192 | 4/1997 | Chiou | 222/192 X |

*Primary Examiner*—Kevin P. Shaver

*Attorney, Agent, or Firm*—David & Raymond; Raymond Y. C. Chan

[57] ABSTRACT

A kind of compound-integrated-bottle-body with multi-functions includes of an integrated bottle body, a spray device and a driver, in which the integrated bottle body further includes a first bottle body at the bottom and a second bottle body at the top, which can play their own role respectively and be connected to each other by screws. The receiving threaded head disposed at the bottom of the spray device is connected to a protrusion thread of the small opening of the second bottle body by screws. Also there is one straw extended into the second bottle body to suck water. The connecting groove of the spray device is connected to the click-on plug of the driver. And also, its spray nozzle at the front side is connected to the spray pipe by screws, which is connected to the driver fixedly. While the output axle of driving parts in the driver can be either connected to the electrical fan head or the massage ball head. With the structure mentioned above, the first bottle at the bottom can contain edible liquids, and the second bottle can absorb water for the gun spray. Additionally, there are one compound electrical fan to generate winds and one driver, which can do massage. Therefore, this utensil can meet the purpose of multi and compound functions.

20 Claims, 5 Drawing Sheets

AVAILABLE BEST AVAILABLE COPY AVAILABLE

MULTI-FUNCTIONAL COMPOUND INTEGRATED BOTTLE

FIELD OF THE PRESENT INVENTION

The present invention relates to a multi-functional compound integrated bottle, and more particularly to a compound use of an integrated bottle with spray gun and driver in order to reach the purpose of being new and practical with multi-function.

BACKGROUND OF THE PRESENT INVENTION

In the fast moving pace of the society today, people often on the run on everything. Fast food has become our standard lunch, and even replaced some of our traditional dinner. Time conserving has become a very importing task that we do today. Therefore, compact staff with multiple function is very popular because we want to get as much done in as little time as possible. For example, the multi-functional pocket knife, which combined knife, screw driver, scissors, and some even the wine opener, is very popular because of its convenient tools set up.

The design of normal bottle, which is used for store water, often ignores its aspiration and market demand but only emphasizes on its function as a water container. Thus, it is not enough for the changing market. As for this disadvantage, the inventor provides this multi-functional compound integrated bottle after researching for long time in order to offer a device of compound integrated bottle to combine a spray gun, which can be played with spraying out water, an electrical fans, which can blow winds, and a driver, which can do massage. This device provides not only the function of water storing, but also the aspiration of playing with the spray gun and other practical results, such as dispersing heat and removing heat exhaustion from human body and massaging to get rid of tiredness, and in this case, by increasing its additional value, the traditional image.

SUMMARY OF THE PRESENT INVENTION

The main objective of the present invention is to provide a multi-functional compound integrated bottle which has a bottle combined with a spray device, a driver and an electrical fan for reaching of multiple functions of water containing, water spraying, body massaging, and generating cool wind.

Another objective of the present invention is to provide a multi-functional compound integrated bottle which not only gives the above describe multiple function but also has attractive outside appearance.

Accordingly, the present invention provide a multi-functional compound integrated bottle which comprises an integrated bottle body, a spray device, and a driver.

The integrated bottle body comprises a first bottle body and a second bottle body disposed on top of the first bottle body; a small opening with a protrusion thread disposed at a top portion of the second bottle body, a clip attached to the second bottle body for carrying on or hanging to one's body by ropes;

The spray device comprises a receiving threaded head provided at a bottom portion thereof for connecting to the protrusion thread of the small opening of the second bottle body, a dip tube extends into the second bottle body for absorbing water, a spray pipe for providing a path for spreading out water stored in the second bottle through the dip tube, a trigger for releasing water out, a spray nozzle for spraying out water, and a connector groove indentedly provided at a top portion of the spray device;

The driver comprises a connecting pipe which connects the spray device with the spray nozzle, a click-on device disposed at a bottom end of the driver for clicking on to the connecting groove of the spray device that combines the driver and the spray device into one body, a driving part is being centrally installed inside said driver, in which the driving part further comprises an output axle, an eccentric wheel, a motor, a battery, an electrical rotating outlet controlled and dredged the energy which is disposed in an interior of the driver because of its blocking effect.

DETAILED DESCRIPTION OF THE PREFERRED EMBODIMENT

Figure 1:
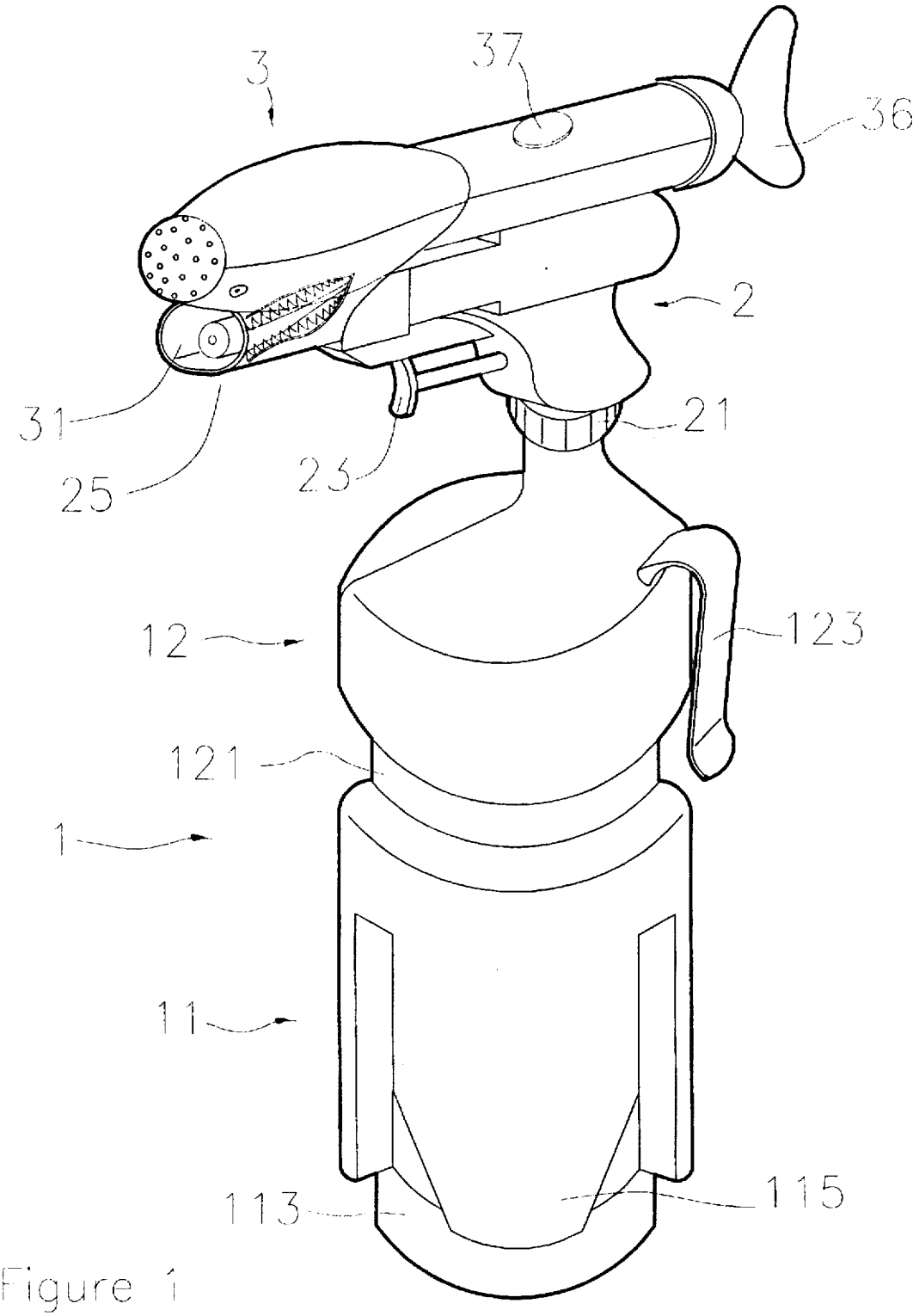
FIG. 1 is a perspective view of a first preferred embodiment of the present invention.

As shown in FIG. 1 to FIG. 4, the multi-functional compound integrated bottle comprises of an integrated bottle body 1, a spray device 2, and a driver 3. The integrated bottle body 1 comprises a first bottle body 11 and a second bottle body 12 connected on top of the first bottle body 11. The first bottle body 11 is integrally screwed to the second bottle body 12. A top portion of the first bottle body 11 has a protruding connecting portion 111 thereon. An opening 112 is formed at a bottom portion of the first bottle body 11, in which the opening 112 is sealed by a lid cover 113. Therefore, the first bottle body 11 can store editable liquids. Also a flexible straw 114, is disposed inside the first bottle body 11. One end of the flexible straw 114 is extended outside the lid cover 113 and bent downward to be concealed around the wall of the first bottle body. When someone raise up this straw 114, he may suck the liquid contained in the first bottle body 11 through the straw 114. Besides, there is a position-fixing-buckle 115 attached to a lower surface of the first bottle body 11 to fix and conveniently carry when placing on a bicycle.

At a bottom of the second bottle body 12 provides a receiving connecting portion 121, which is engagedly screwed to the protruding connecting portion 111 of the first bottle body 11. In this case, the first bottle body 11 can be mutually integrated with the second bottle body 12 to become one body. The second bottle body 12 further comprises a small opening 122 with a protrusion thread 124 disposed at a top portion of the second bottle body 12. Furthermore, by using a clip 123 attached to the surface of the second bottle body 12, the integrated bottle body 1 can be easily carried on or hanged to one's body by ropes.

The spray device 2 comprises a receiving threaded head 21 at the bottom portion thereof for connecting to the protrusion thread 124 of the small opening 122 of the second bottle body 12, a dip tube 22 extended into the second bottle body 12 for sucking water, a spray pipe 24 installed therein for providing a path for spreading out water stored in the second bottle body 12 through the dip tube 22, a trigger 23 mounted thereon for releasing water out through the spray pipe 24, a spray nozzle 25 screwed on a head end of the spray pipe 24 for spraying out water therethrough, and a connector groove 26 indentedly provided at a top portion of the spray device 2 for connecting with the driver 3.

The driver 3 as described above, comprises a connecting pipe 31 which embeds the spray device 2 and the spray nozzle 25, a click-on plug 32 integrally extended downwardly and rearwardly from a bottom side of the driver 3 for inserting into the connecting groove 26 of the spray device 2 so as to combine the driver 3 and the spray device 2 into one body, a driving device 33 which is centrally installed inside this driver 3, comprising an output axle 331 extended out of a front end of driver 3, an eccentric wheel 332 disposed on the output axle 331, a motor 333 connected with the output axle 331 for driving it to rotate, a battery 334 connected with the motor 333 for providing power source, and an electrical rotating outlet 36 controlled and dredged the energy and located in the interior of the driver 3 because fits blocking effect.

Figure 2:
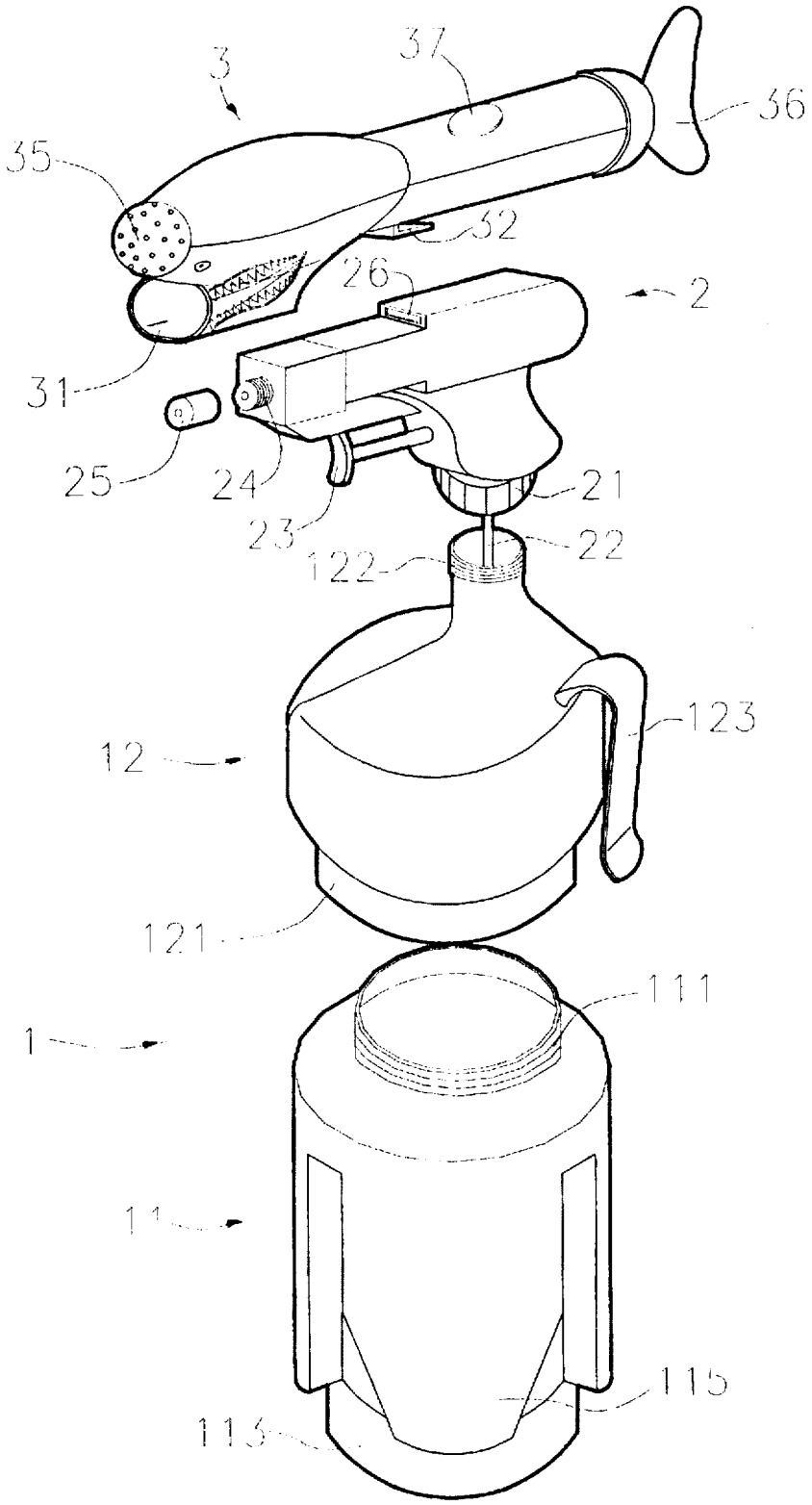
FIG. 2 is an exploded perspective view of the above first preferred embodiment of the present invention.
Figure 3:
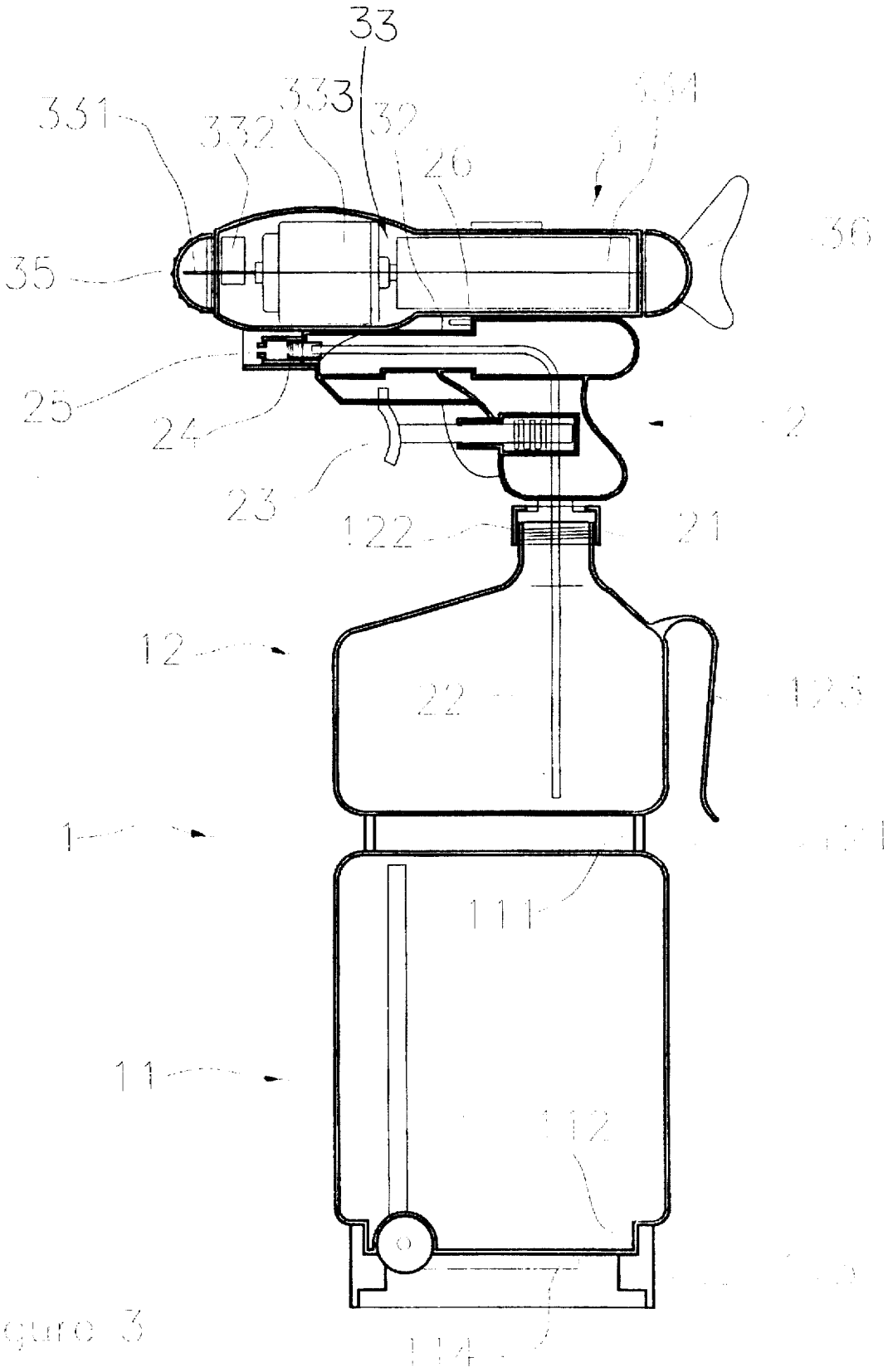
FIG. 3 is a sectional view of the above first preferred embodiment of the present invention.
Figure 4:
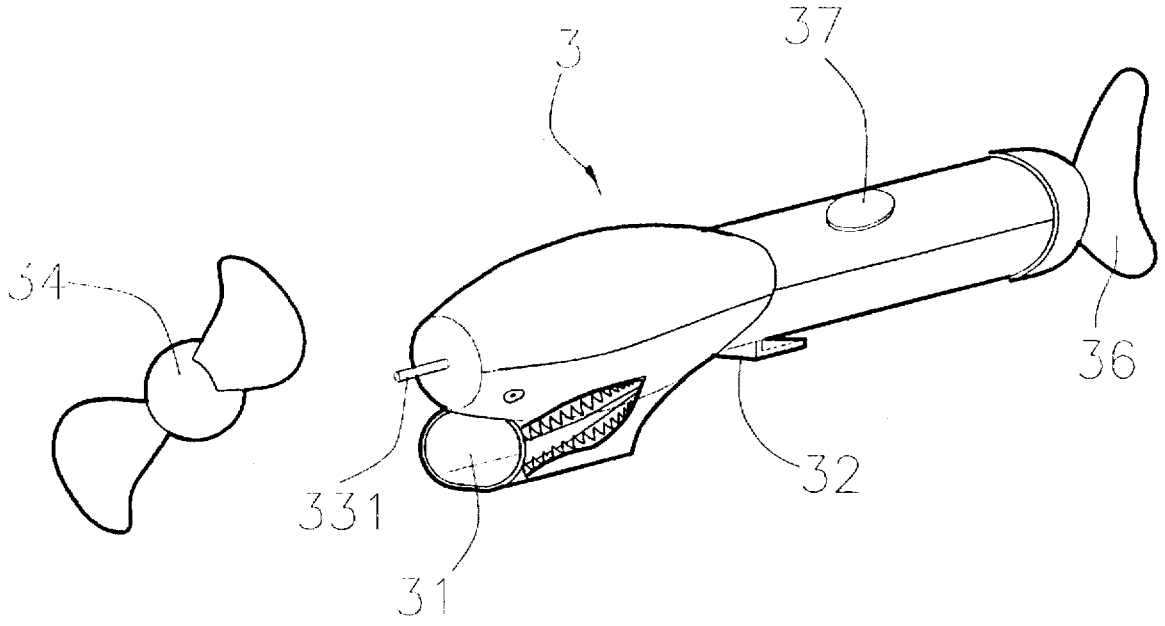
FIG. 4 is a perspective view of an alternative mode of the above first preferred embodiment of the present invention.

The output axle 331 of the driving device 33 is driven by the motor 333. The eccentric wheel 332 is installed at the most front portion of the driver 3. As shown in FIGS. 1 to 3, the output axle 331 is connected to a massage ball head 35. The output axle 331 and the massage ball head 35 can be under shaking and trembling conditions driven by the eccentric wheel 332 to provide massaging function, while the battery 334 provides electrical energy to the motor 333. As shown in FIG. 4, the massage ball head 35 can also be replaced by an electrical fan head 34 to blow and disperse heat. A protruding connector 37 is disposed at a top surface of the driver 3 for holding the fan head 34 or massage ball head 35 when it is not used. After the description of the above structure, the following are the characteristics of this invention:

1. In this invention, not only the first bottle body 11 at the bottom of the integrated bottle body 1 can store and contain editable liquids with the function of storing water, but also the second bottle body 12 can be integrated to be the spray device 2 to suck water and to add mist and spraying water and put delight to this device.

2. In this invention, the driver 3 can be integrated at the top of the spray device 2. At the top of the output axle 331 of the driver 3, the electrical fan head 34 can be installed with the function of generating wind. By taking advantage of the position-fixing-buckle 115 of the first bottle body 11 or the clip 123 of the second bottle body 12, this device can be carried on personally or hung on some beating things, such as bicycles, automobiles and desks to reach the purpose of cooling and dispersing heat. Meanwhile, the spray device 2 provides spraying water, which will be changed into the form of mist to reach the purpose of cooling and removing heat exhaustion.

3. Furthermore, in this invention, the output axle 331 of the driver 3 can be chosen to get connected to the massage ball head 35. This ball can be released from the protruding connector 37 of the driver 3 and connected to the output axle 331. With the eccentric wheel 332 installed in the output axle 331, it can show its function of shaking and trembling. Therefore, this driver 3 has the function of massaging tired and sort area of the body when the massage ball head 35 is connected to the output axle 331.

As shown in the above description, this case provides one compound-integrated-bottle-body structure. The first bottle body 11 at the bottom of the integrated bottle body 1 can contain editable liquids with the function of storing up water. The second bottle body 12 can provide spraying water to the spray device 2, which may afford delight to this device of spraying water while playing with it. Moreover, one compound electrical fan to generate cool air and one driver to do massage are attached to the driver 3. Supported by all these parts, this compound bottle body can meet its purpose of being complicated applied with multi-function. And also, the whole body is designed very reasonably and perfectly for its simple operation and usage and easily carried about. When all the above advantages are concerned, this device should be regarded as very practical with great usage in the industrial development.

In summary, this case not only is invented initially by the inventor, but also the structure it reveals or the installation can reach its original expectation of practical value and function. Therefore, this device already meet fully patentable requirement for a utility patent, which should be new, practical and advanced.

Figure 5:
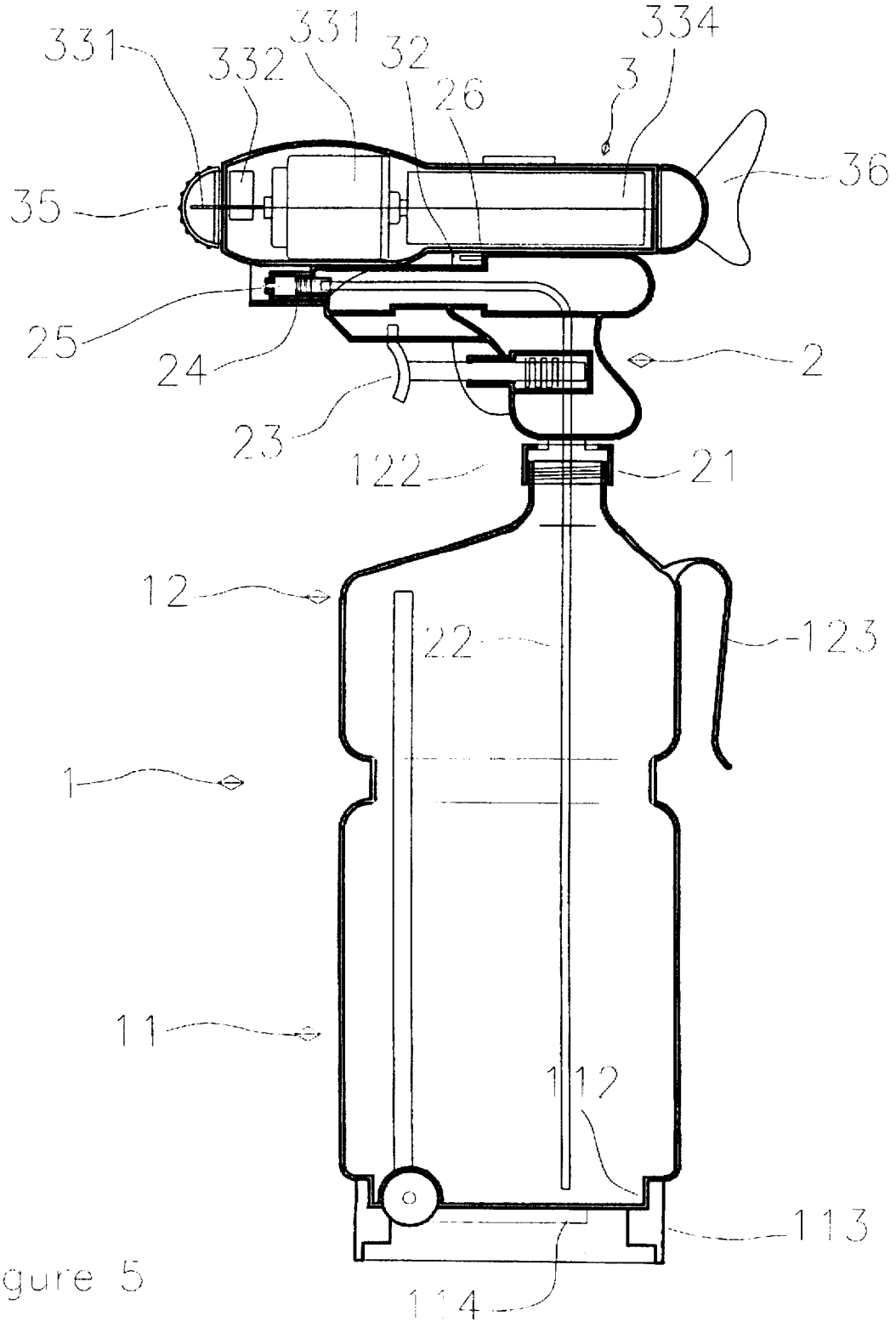
FIG. 5 is a sectional view of a second preferred embodiment of the present invention.

As shown in FIG. 5, a second embodiment of the present invention is illustrated, in which the first bottle body 11 and the second bottle body 12 are integrally constructed as an integrated bottle body. Furthermore, the flexible straw 114 is further extended into the second bottle body 12 and the dip tube 22 is also extended to the bottom of the first bottle body 11.

What is claimed is:

1. A multi-functional compound integrated bottle, comprising an integrated bottle body, a spray device, and a driver, in which, said integrated bottle body comprises a first bottle body and a second bottle body connected on top of said first bottle body, an opening being formed at a bottom portion of said first bottle body, in which said opening is sealed by a lid cover, said second bottle body further comprising a small opening with a protrusion thread disposed at a top portion of said second bottle body;

said spray device comprising a receiving threaded head at a bottom portion thereof for connecting to said protrusion thread of said small opening of said second bottle body, a dip tube extended into said second bottle body for sucking purpose, a spray pipe installed thereon for prodding a path for spreading out water stored in said second bottle body through said dip tube, a trigger mounted thereon for releasing water out through said spray pipe, a spray nozzle connected on a head end of said spray pipe for spraying out water therethrough, and a connecting groove indentedly provided at a top portion of said spray device for connecting with said driver;

said driver comprising a click-on plug integrally extended downwardly and rearwardly from a bottom side of said driver for inserting into said connecting groove of said spray device so as to combine said driver and said spray device into a one body structure, a driving device which is centrally installed inside said driver comprising an output axle extended out of a front end of said driver, an eccentric wheel disposed on said output axle, a motor connected with said output axle for driving it to rotate, a battery connected with said motor for providing power source, and a fan head connected to a front end of said outlet axle.

2. A multi-functional compound integrated bottle, as recited in claim 1, in which a protruding connector is disposed at a top surface of said driver for holding a massage ball head.

3. A multi-functional compound integrated bottle, as recited in claim 1, in which at a top portion of said first bottle body has a protruding connecting portion thereon, at a bottom of said second bottle body providing a receiving connecting portion which is engagedly screwed to said protruding connecting portion of said first bottle body.

4. A multi-functional compound integrated bottle, as recited in claim 2, in which at a top portion of said first bottle body has a protruding connecting portion thereon, at a bottom of said second bottle body providing a receiving connecting portion which is engagedly screwed to said protruding connecting portion of said first bottle body.

5. A multi-functional compound integrated bottle, as recited in claim 1, in which a flexible straw is disposed inside said first bottle body, wherein one end of said flexible straw is extended outside of said lid cover and bend downward to be concealed around an wall of said first bottle body.

6. A multi-functional compound integrated bottle, as recited in claim 4, in which a flexible straw is disposed inside said first bottle body, wherein one end of said flexible straw is extended outside of said lid cover and bend downward to be concealed around an wall of said first bottle body.

7. A multi-functional compound integrated bottle, as recited in claim 6, in which a position-fixing-buckle is attached to a lower surface of said first bottle body to fix said integrated bottle body for carrying when placed on a bicycle.

8. A multi-functional compound integrated bottle, as recited in claim 7, in which said second bottle body of said integrated bottle body further comprises a clip attached to a surface of said second bottle body, so that said integrated bottle body is capable of carrying on and hanging to one's body by ropes.

9. A multi-functional compound integrated bottle, as recited in claim 1, in which said driver further comprises a connecting pipe which embeds said spray device and said spray nozzle.

10. A multi-functional compound integrated bottle, as recited in claim 8, in which said driver further comprises a connecting pipe which embeds said spray device and said spray nozzle.

11. A multi-functional compound integrated bottle, comprising an integrated bottle body, a spray device, and a driver, in which, said integrated bottle body comprises a first bottle body and a second bottle body connected on top of said first bottle body, an opening being formed at a bottom portion of said first bottle body, in which said opening is sealed by a lid cover, said second bottle body further comprising a small opening with a protrusion thread disposed at a top portion of said second bottle body;

said spray device comprising a receiving threaded head at a bottom portion thereof for connecting to said protrusion thread of said small opening of said second bottle body, a dip tube extended into said second bottle body for sucking purpose, a spray pipe installed thereon for providing a path for spreading out water stored in said second bottle body through said dip tube, a trigger mounted thereon for releasing water out through said spray pipe, a spray nozzle connected on a head end of said spray pipe for spraying out water therethrough, and a connecting groove indentedly provided at a top portion of said spray device for connecting with said driver;

said driver comprising a click-on plug integrally extended downwardly and rearwardly from a bottom side of said driver for inserting into said connecting groove of said spray device so as to combine said driver and said spray device into a one body structure, a driving device which is centrally installed inside said driver comprising an output axle extended out of a front end of said driver, an eccentric wheel disposed on said output axle, a motor connected with said output axle for driving it to rotate, a battery connected with said motor for providing power source, and a massage ball head connected to a front end of said outlet axle.

12. A multi-functional compound integrated bottle, as recited in claim 11, in which a protruding connector is disposed at a top surface of said driver for holding a fan head.

13. A multi-functional compound integrated bottle, as recited in claim 11, in which at a top portion of said first bottle body has a protruding connecting portion thereon, at a bottom of said second bottle body providing a receiving connecting portion which is engagedly screwed to said protruding connecting portion of said first bottle body.

14. A multi-functional compound integrated bottle, as recited in claim 12, in which at a top portion of said first bottle body has a protruding connecting portion thereon, at a bottom of said second bottle body providing a receiving connecting portion which is engagedly screwed to said protruding connecting portion of said first bottle body.

15. A multi-functional compound integrated bottle, as recited in claim 11, in which a flexible straw is disposed inside said first bottle body, wherein one end of said flexible straw is extended outside of said lid cover and bend downward to be concealed around an wall of said first bottle body.

16. A multi-functional compound integrated bottle, as recited in claim 14, in which a flexible straw is disposed inside said first bottle body, wherein one end of said flexible straw is extended outside of said lid cover and bend downward to be concealed around an wall of said first bottle body.

17. A multi-functional compound integrated bottle, as recited in claim 16, in which a position-fixing-buckle is attached to a lower surface of said first bottle body to fix said integrated bottle body for carrying when placed on a bicycle.

18. A multi-functional compound integrated bottle, as recited in claim 17, in which said second bottle body of said integrated bottle body further comprises a clip attached to a surface of said second bottle body, so that said integrated bottle body is capable of carrying on and hanging to one's body by ropes.

19. A multi-functional compound integrated bottle, as recited in claim 11, in which said driver further comprises a connecting pipe which embeds said spray device and said spray nozzle.

20. A multi-functional compound integrated bottle, as recited in claim 18, in which said driver further comprises a connecting pipe which embeds said spray device and said spray nozzle.

* * * * *